US012281800B2

(12) United States Patent
Oberndorfer

(10) Patent No.: US 12,281,800 B2
(45) Date of Patent: Apr. 22, 2025

(54) ARRANGEMENT FOR REGULATING A COOKING OPERATION

(71) Applicant: Lukas Oberndorfer, Vienna (AT)

(72) Inventor: Lukas Oberndorfer, Vienna (AT)

( * ) Notice: Subject to any disclaimer, the term of this patent is extended or adjusted under 35 U.S.C. 154(b) by 257 days.

(21) Appl. No.: 16/462,831

(22) PCT Filed: Jul. 21, 2017

(86) PCT No.: PCT/AT2017/060184

§ 371 (c)(1),
(2) Date: May 21, 2019

(87) PCT Pub. No.: WO2018/094429

PCT Pub. Date: May 31, 2018

(65) Prior Publication Data

US 2020/0056789 A1 Feb. 20, 2020

(30) Foreign Application Priority Data

Nov. 22, 2016 (AT) ..... A 60008/2016

(51) Int. Cl.
*F24C 7/08* (2006.01)

(52) U.S. Cl.
CPC ..... *F24C 7/082* (2013.01)

(58) Field of Classification Search
CPC ..... F24C 3/12–126; F24C 7/08–086; H05B 1/0266; H05B 1/0263; H05B 3/74–748; H05B 6/12; H05B 6/06–062
USPC ..... 219/445.1, 446.1, 447.1, 448.11, 448.12, 219/509, 510, 518, 493, 494
See application file for complete search history.

(56) References Cited

U.S. PATENT DOCUMENTS 9,013,322 B2 * 4/2015 Roberson ..... G08B 21/00 175/2
2006/0234177 A1 10/2006 Yu et al.
2007/0182367 A1 * 8/2007 Partovi ..... H02J 7/00 320/108
2011/0072932 A1 * 3/2011 O'Keefe ..... G05G 1/10 74/504
2012/0060030 A1 * 3/2012 Lamb ..... H04L 63/0876 726/2

(Continued)

FOREIGN PATENT DOCUMENTS

CN 102012049 A 4/2011
CN 102625892 A 8/2012

(Continued)

*Primary Examiner* — Sang Y Paik
*Assistant Examiner* — Bonita Khlok

(57) ABSTRACT

An arrangement for controlling a cooking operation has a housing, which is designed to accommodate mechanical and electronic components of the arrangement, a fastening device, which is designed to fasten the housing on a cooker, a drive unit, which is connected to an adapter piece and is designed to move the adapter piece, wherein the movement of the adapter piece actuates an operating element of the cooker, and wherein actuation of the operating element regulates the performance of the cooker, a microprocessor unit, which is designed to evaluate data relating to a cooking process, and to activate the drive unit in order to move the adapter piece, and at least one power-supply unit, wherein the power-supply unit is designed to supply the arrangement with power.

27 Claims, 3 Drawing Sheets

(56) References Cited

U.S. PATENT DOCUMENTS

| | | | | |
|---|---|---|---|---|
| 2012/0325197 | A1* | 12/2012 | Legaspi | F23N 5/242 126/42 |
| 2013/0260320 | A1 | 10/2013 | Townsend | |
| 2016/0051078 | A1 | 2/2016 | Jenkins et al. | |

FOREIGN PATENT DOCUMENTS

| | | | |
|---|---|---|---|
| CN | 105373032 | A | 3/2016 |
| CN | 105841205 | A | 8/2016 |
| CN | 205535985 | U | 8/2016 |
| KR | 101552256 | B1 | 9/2015 |

* cited by examiner

ARRANGEMENT FOR REGULATING A COOKING OPERATION

TECHNICAL FIELD

The present invention relates to an arrangement for controlling a cooking process, in particular for the automatic power control of a stove.

BACKGROUND

For many people it is difficult to prepare food correctly. For example, many people choose too low or too high temperatures when heating or frying food. If the temperature is too low, food may not be cooked, or the preparation may take a long time. If the temperature is too high, cooked dishes can boil away, overcook or burn. In both cases (too low or too high temperatures), the taste of the food can suffer and, in addition, unnecessary energy can be wasted.

For example, document US 2016/0051078 A1 discloses an arrangement which can measure the temperature in the cooking pot or a pan. If the temperature is not suitable for a current cooking operation (for example too high or too low), the temperature is automatically adjusted by the stove. The user is not required to intervene. Rather, the temperature is automatically regulated. Such an arrangement was also presented by the Institute of Electrical and Computer Engineering of Cornell University.

However, usually the acquisition of such an intelligent stove that is capable of automatically controlling and regulating the cooking process is quite expensive. The object of the present invention is therefore to provide an arrangement for controlling a cooking process which is a simple and cost-effective compared to known solutions.

OVERVIEW

The above-mentioned object is achieved by the arrangement according to claim 1. Various execution examples and further developments of the invention are the subject matter of the dependent claims.

An arrangement for controlling a cooking process is described. The assembly comprises a housing trained to hold mechanical and electronic components of the assembly, a mounting device trained to attach the housing to a stove, a drive unit, that is connected to an adaptive piece and that is trained to move the adapter piece, whereby a control element of the stove is actuated by the movement of the adapter piece and wherein the power of the stove is controlled by an actuation of the control element, a microprocessor unit trained to evaluate data relating to a cooking process and to control the drive unit in order to drive an adapter piece, and at least one power supply unit, wherein the power supply unit is trained to supply the device with energy.

BRIEF DESCRIPTION OF THE DRAWINGS

The invention is explained in more detail below with reference to the examples shown in the figures. The figures are not necessarily true to scale and the invention is not limited to the illustrated aspects. Rather, it is important to present the principles underlying the invention. To the figures.

DETAILED DESCRIPTION

The figures show only the basic principle of an arrangement according to the invention by means of various examples. However, the invention is not limited to the illustrated examples.

Figure 1:
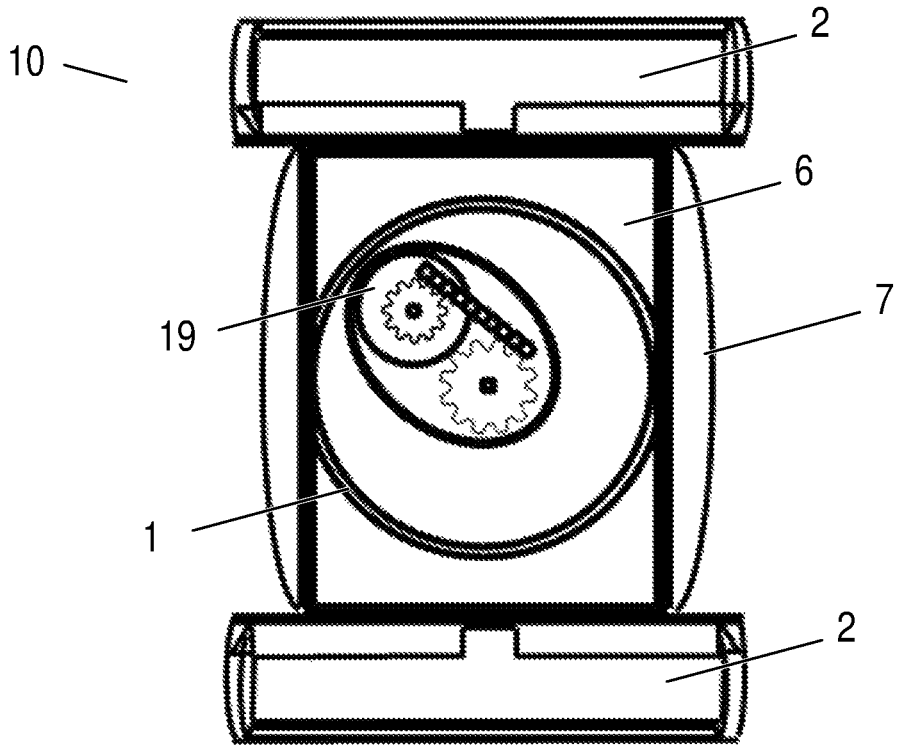
FIG. 1 shows a front view of an example of an arrangement for controlling a cooking process.

FIG. 1 exemplarily illustrates a front view of an arrangement for controlling a cooking process. The arrangement is also referred to as the actuation module 10 in the following. A stove usually has several cooking plates and several control elements. Each of the control elements is assigned to a cooking plate. At many stoves, the control elements are designed in the form of rotary knobs. The temperature of the corresponding cooking plate can be controlled by means of the rotation of the control element. Other stoves are known at which the operating elements are designed in the form of push buttons. For example, by pressing a first button the temperature of a hot plate can be increased, and by pressing a second button it can be reduced again. In case of electric stoves, the control elements especially regulate the (heating) power of the hot plate, in the case of gas stoves the intensity of burner gas supply. The actuation module 10 shown in FIG. 1 has a housing 7 which is trained to receive the mechanical and electronic components of the actuation module 10 and to be mounted on or at a control element of a stove. In doing so the rear side of the housing 7, which is not visible in FIG. 1, may be facing the stove.

The actuation module 10 represents a retrofit automated control panel respectively a stove extension that can be integrated into new stoves. The actuation module 10 is trained to automatically control the power of a gas cooker or an electric cooker in an energy-efficient manner. At the same time the arrangement also provides various security features. The arrangement is for example trained to be operated on the basis of preprogrammed cooking processes respectively on the basis of information from a temperature sensor. A temperature sensor may be for example placed in a cooking pot or in a cooking pan or in the vicinity thereof. The temperature sensor may also have an image sensor which may be arranged at a suitable location near the hearth, for example laterally behind the hearth. In case it is necessary for certain cooking processes (for example pancakes), the temperature sensor may also be attached to the side of a cooking pot or cooking pan and thereby for example determine bottom cooking pot or cooking pan temperature approximately respectively intelligently on the basis of the temperatures measured at the side of the cooking pot or cooking pan. In general, the temperature sensor can therefore measure cooking pot or cooking pan temperature either directly or indirectly. The measured temperatures can be transmitted to the actuation module 10 for example via a wireless connection.

Depending on whether the arrangement (control panel, actuation module) controls a cooking process or a frying process, it is capable of normalizing the power according to the data of the temperature sensor or further sensors. For instance, a cooking process may require lower temperatures than a frying process. Further sensors may for example feature an image sensor which may supply additional data which might be useful for a cooking process. Further sensors may for example also supply further input data such as for example input data of sample cooking processes or for a particular recipe. Additional input data may for example consist of information on when to add which ingredient. Simultaneously, the stove power can be optimally controlled. By controlling the system for example peak temperatures can be avoided respectively the laws of specific heat capacity and entropy can be applied in an energy-efficient manner. By means of this control system, for example fully automated robotic kitchens or any other future innovative cooking solutions may also be designed to be energy efficient. Normalization of stove power can for example also be utilized in a manner that the actuation module 10 executes cooking processes (for example cooking times and temperatures) from third parties (for example cooking apps) energy efficient. Cooking applications of this kind can for example replace conventional cookbooks and provide the user with instructions for making various dishes.

The actuation module 10 is trained to be operated on the basis of data which can for example be provided by one or more temperature sensors. One or more temperature sensors may for example be arranged in, at or at a certain distance (for example 0-5 cm) to a cooking pan or a cooking pot. Optionally, the actuation module 10 can also be operated on the basis of data provided by one or more image sensors. One or more image sensors may for example be attached laterally behind the stove or at any other suitable location. Optionally the actuation module 10 can also include further pre-programmed data, which can be received for example via an internet connection or via any other suitable sources (for example apps, intelligent refrigerator, barcodes, etc.). For this purpose, the actuation module 10 can for example establish a wireless connection to one or more external devices. For this purpose, the actuation module 10 can for example have a communication unit (not shown).

The actuation module 10 allows for example precision roasting and precision cooking. Furthermore, safety features can be integrated in the actuation module. The actuation module 10 can for example receive and import input data relating to (cooking) times and the corresponding stove powers. The input data can for example be received from a corresponding smartphone application respectively app. Internet pages with Internet recipes may transmit corresponding input data to a smartphone app respectively directly to the actuation module 10. The actuation module 10 may for example have a (pivotable) manual control unit 1, which is designed in the form of a circular touchpad or touch screen 14, 15 (hereinafter referred to as a (pivotable) display; cf. FIGS. 4 and 5). The input data can be imported and displayed on such a display 14, 15. Additionally, for example barcodes on for example recipes or food packagings (not shown) can be scanned with the image sensor of a smartphone or with an image sensor (not shown) that is arranged in the front cover 8 of the actuation module 10 or in the (pivotable) manual control unit 1. Inputs may also be transmitted by cooking apps, manual smartphone inputs, voice inputs, gesture inputs, or for example from a tablet computer that is designed for this purpose, which may be placed at eye level somewhere next to the stove.

Conventional (retrofittable) automated arrangements for regulating stove power have various disadvantages. The present arrangement attempts to overcome these disadvantages. Conventional arrangements, for example, usually take up a lot of space and are unwieldy. The arrangement shown in the figures is comparatively space-saving and small. This is for example achieved by a decentralized energy supply, which is described in the following with reference to the figures.

The arrangements described in the following merely represent examples of how the described functions can be implemented in an arrangement. However, the various functions can also be implemented in a variety of other suitable ways. The arrangement can be a control panel or similar device which for example has no rotating element on the outside, and can be trained to ensure a manual regulation of a drive shaft in which an adapter piece is mounted. Such a drive shaft and the adapter piece will be described in more detail below.

Figure 2:
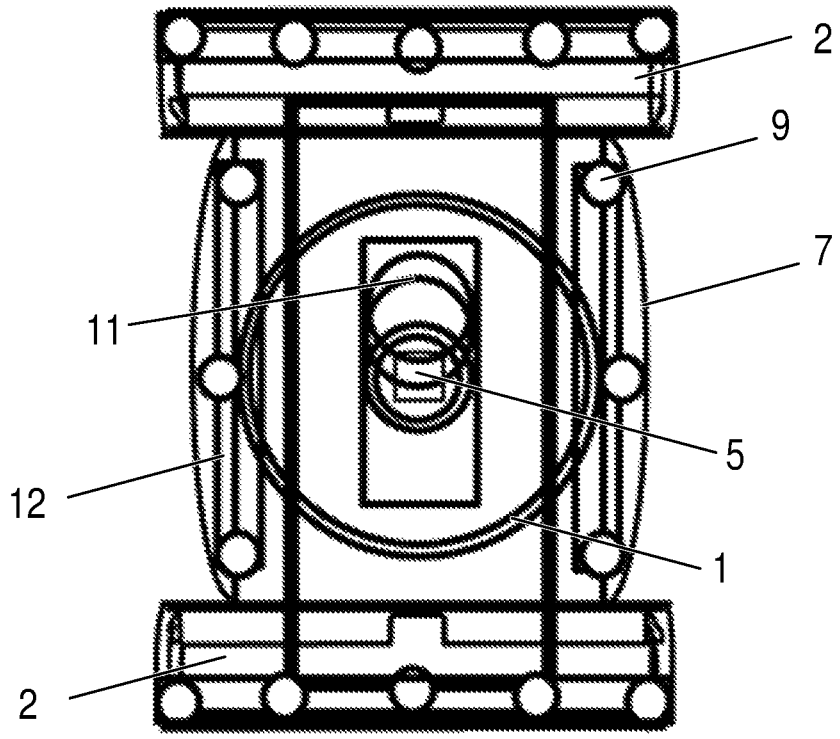
FIG. 2 shows a rear view of an example of an arrangement for controlling a cooking process.
Figure 3:
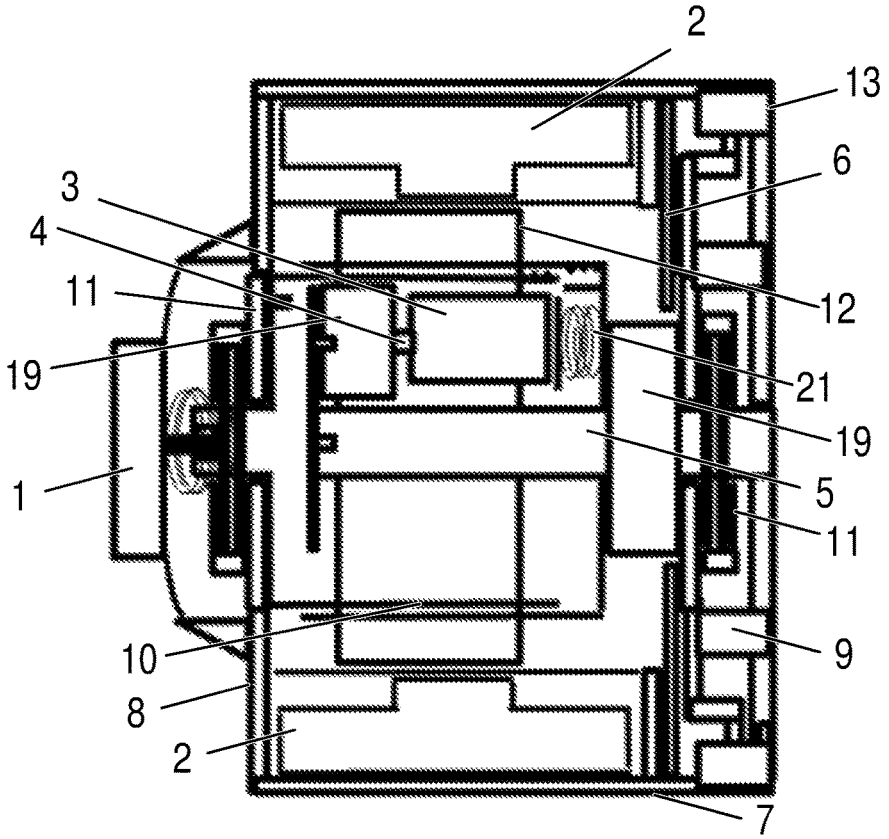
FIG. 3 shows a cross section of an example of an arrangement for controlling a cooking process.

Conventional retrofittable stove control systems are usually too bulky to mount them on stoves at which the rotary knobs are arranged close to each other. Especially at European gas stoves, the rotary knob elements are often arranged very close to each other. Referring to FIGS. 1, 2 and 3, the power supply units 2 are therefore arranged peripheral in the present actuation module. That is, if the actuation module 10 is mounted on a hearth, the power supply units 2 are arranged above and/or below the corresponding operating element. This allows a slender appearance of the assembly, as well as a cost-effective and comfortable power supply. The energy supply units 2 can for example have one or more batteries or accumulators (rechargeable batteries). These may for example be relatively bulky AA rechargeable batteries or larger. Smaller batteries are also possible, but they offer lower power and shorter lifetime. By means of the smallest possible energy supply units 2, it can be achieved that the arrangement is not too bulky to mount on hearths in which the rotary knobs are close to one another. The layout of the assembly in the form of a control panel or actuation module 10 ensures that the actuation module 10 is thin at the location which is essential for applications of this type. This is in particular in the middle of the arrangement, which is arranged in the areas between the operating elements (for example rotary knobs) after installation on the hearth. At this point, the distance between the rotary knobs on a stove with mechanical knobs (rotary knobs) is basically the lowest.

The present arrangement provides sufficient (additional) space which, for example, enables the implementation of additional sensors. Additional sensors (not shown) can for example consist of sensors for the comprehensive detection of reducing gases, such as for example volatile organic substances (VOCs). Furthermore, the arrangement provides sufficient space for removable fixation elements 9 (cf. for example FIG. 2), which can be for example mounted on adhesive elements. However, the thin, attractive and inconspicuous design is retained. The arrangement in the form of a control panel makes it possible to remove the arrangement for example by means of non-removable magnets and the removable fixation elements 9 from the hearth whenever necessary. The removable magnets and the fixation elements 9 form a detachable structural unit which is arranged in the actuation module 10. The arrangement can for example also be fixed directly to the hearth by means of a snap mechanism or any other suitable means.

The static control panel technology for example allows the installation of a mechanical child safety function (not shown) and the implementation of an optional safety cover (not shown) which must be removed before the cooking process can be initiated. Such a safety cover can for example be arranged over the front side of the actuation module 10 in such a way that operation of the actuation module 10 is not possible. For example, the safety cover first has to be removed from the actuation module 10 by means of a technique that is as difficult as possible for children to execute, in order to put it into operation. However, such a safety cover is optional. The safety cover can for example prevent a manual control unit 1 of the actuation module 10 from being actuated as long as the safety cover is attached to the actuation module 10.

The additional space generated by the constructional technology can also be used to implement (thermal) isolation. The (thermal) insulation can, for example, protect the actuation module 10 from water and moisture, so that these are prevented from entering the interior of the actuation module 10. By providing seals, the actuation module 10 is very durable.

As illustrated in FIG. 1, the actuation module 10 has a manual control unit 1 on its front side. By way of a (possibly electromagnetic) micro-slip clutch 19, for example, a movement of the manual control unit 1 can be transmitted to the operating element of the stove. As already described above, the actuation module 10 is mounted on the operating element of a stove. The operating element is thus covered by the actuation module 10 and can no longer be actuated directly as long as the actuation module is attached to the hearth. The manual control unit 1 can be similar in shape to a control element. For example, the manual control unit 1 can be designed as a rotary knob. However, the manual control unit 1 can for example also feature one or more keys. The actuation module 10 has a mechanism which transmits a movement of the manual control unit 1 to the operating element. This mechanism may include a micro-slip clutch 19 but may, in principle, also be implemented in any suitable manner. A rotation of the manual control unit 1 can, for example, be transmitted to a rotary knob on the hearth. Likewise, if the manual control unit 1 and the control element on the cooker are designed as a button, the button on the hearth can be actuated when the manual control unit 1 is actuated.

The manual control unit 1 can be mounted on the front cover 8 and can for example be removed in order to change the position of the actuation module 10 by means of the position adjustment elements 11. The manual control unit 1 provides an immediate manual intervention function for a situation in which a consumer requires more stove power than currently provided by the operating system of the actuation module 10 or in case the actuation module 10 is damaged or faulty. The manual control unit 1 can also easily be used with the adapter piece 5 stand alone for example in case the actuation module 10 must be sent to the manufacturer respectively maintenance in order to for example resolve defects of the actuation module 10. The manual control unit 1 can for example only be used by a consumer by first pressing and then rotating the manual control unit 1, this function can be implemented by means of the manual control unit 1 of the actuation module 10. The manual control unit 1 may for example comprise at least one touch sensor, image sensor or proximity sensor (not shown) which for example decouples a (eventually electromagnetic) micro-(slip) clutch 19 as soon as the touch sensor detects that the user manually engages the control of the stove power while a cooking process is being performed by the actuation module 10 in order to protect the transmission from the torque caused by this manual interference.

FIG. 2 illustrates an example of a rear view of an actuation module 10. As different stoves may have different dimensions and also the operating elements of different stoves basically have different dimensions, the actuation module 10 may have an adjustment rail 12 and one or more position adjustment elements 11. In addition, the actuation module 10 may feature an adapter piece 5. By means of the adjusting rail 12, the position of the manual control unit 1 can for example be modified in order to adapt to the geometry of the cooker.

FIG. 3 shows a cross section of a side view of an actuation module 10. As already described with reference to FIG. 1, the energy supply units 2 can be arranged on an upper side (upper end) and/or on a lower side (lower end) of the actuation module 10. The power supply units 2 can be arranged within the housing 7. The manual control unit 1 can basically be arranged centrally on the front side of the actuation module 10. The manual control unit 1 can partly protrude from the housing 7 or can be arranged entirely outside the housing 7 and extend into the interior of the actuation module 10. An inner part of the manual control unit 1 is also designated as 1 in FIG. 3. The manual control unit 1 can for example be connected to the operating element of a cooker via the adapter piece 5 and the micro-(slip) clutch 19. The position adjusting elements 11 on the rear side of the actuation module 10 can be used to adapt the actuation module 10 to various dimensions of the operating elements. Thus, it is for example possible to avoid the actuation module 1 projecting beyond the upper stove edge after installation. If the stove tops are combined with a downward arranged oven, the actuation module 1 may also project downwards so that an opening of the oven is no longer possible without an adaptation to the geometry. In these kinds of scenarios, an adaptation via the adjusting rail 12 can also be performed. The position adjusting elements 11 can for example be displaced along the adjusting rail 12. The actuation module 10 can be attached to a hearth via fixation elements 9, which may feature adhesive elements. However, the fixation elements 9 manifest only one example. The actuation module 10 can be attached to a stove in any other suitable manner.

On its front side, the actuation module 10 can have a front cover 8. The front cover 8 may have seals to protect the housing 7, for example against the ingress of moisture. On its rear side, the actuation module 10 can have a rear cover 13, which can also have seals for sealing the housing 7.

The actuation module 10 can furthermore have an electric motor 3 as well as a motor drive shaft 4, which are arranged inside the housing 7. The actuation module 10 can be controlled by means of a microprocessor unit 6. The microprocessor unit 6 can for example control the electric motor 3. This in turn drives the motor drive shaft 4, which is connected to the manual control unit 1 via a micro-slip clutch 19.

The actuation module 10 can furthermore have a push mechanism. This push mechanism can form an integral part of the various embodiments of the actuation module 10 for gas stoves and electric stoves. With respect to electric stoves, the distance which can be pushed can be less, since in this case the push mechanism can be constructed as a simple displacement mechanism within the actuation module 10. With respect to ranges that feature an actual pushing mechanism (for example standard gas stoves), the constructional unit consisting of for example the electric motor 3 and the (possibly electromagnetic) micro-(slip) clutch 19 can be implemented on a guide rail (not shown) proximal to the manual actuation module 10 and by this means be pushed as well on that guide rail during the execution of a pushing process. This pushing mechanism can prevent the stove, even though it is for example connected within in the Internet of Things (IoT), from being operated remotely by unauthorized persons. Consequently, the actuation module 10 can only be activated by persons who are located in front of the hearth and not by persons from a distance or by cross-linked objects in a smart home which are not authorized to operate the cooking apparatus. Furthermore, the push mechanism can for example be used to decouple one or more gearwheels (schematically illustrated in FIG. 1) which drive the slot in which the adapter piece 5 is mounted from the motor drive shaft 4. The push mechanism can also be used, for example, for various other coupling or decoupling functions. The sprocket or gears may, for example, have a straight, hypoid, conical or any other shape.

A (possibly electromagnetic) micro-(slip) clutch 19 can be installed for example at the distal end of the outer part of the actuation module 10. The (optionally electromagnetic) micro (slip) clutch 19 can also be mounted directly on the motor drive shaft 4 in order to protect the transmission of the electric motor 3 from the extensive torque which can be produced by a manual actuation of the manual control unit 1 or to limit the torque which is generated by a manual actuation. The manual control unit 1 can for example also have a touch sensor, an image sensor, or a proximity sensor (not shown). Such a sensor can for example be trained to detect whether a user touches the manual control unit 1. If a touch of the manual control unit 1 is detected, it can be concluded that the user wants to adjust the hearth power manually. Therefore, if a sensor detects that the user touches the manual control unit 1, the motor 3 can be decoupled from the adapter piece 5, for example the (optionally electromagnetic) micro-(slip) clutch 19 can be decoupled. As a result, the transmission can be protected against the torque generated by the manual adjustment.

The actuation module 10 described has the advantage that the energy supply units 2 are not arranged in the interior of the actuation module 10, as it is the case with known control devices. In the described actuation module 10 the power supply units 2 can indeed also be arranged within the housing 7, nevertheless they are arranged in edge regions, close to housing walls. In the illustrated examples, the power supply units 2 are arranged on the lower side as well as on the upper side of the actuation module 10. However, the power supply units 2 can, in principle, be arranged at any desired decentralized location of the actuation module 10. The energy supply units 2 can for example be removed separately from the actuation module 10. Consequently, the power supply units 2 can be removed and exchanged while the actuation module 10 is attached to the hearth. For example, the housing 7 can be opened at the corresponding locations (for example by means of one or more screws which can be screwed open) to obtain access to an element of the power supply units 2 of the actuation module 10. The opening/closing of the housing 7 by means of screws is merely an example. Access to the power supply units 2 can be made possible in any suitable manner, for example by means of a sliding mechanism or a clip-mechanism.

Thus, the energy supply units 2 can be exchanged in a simple manner even while the actuation module 10 is in operation and for example a cooking episode is carried out. The power supply units 2 of the actuation module 10 can for example have one or more rechargeable batteries, for example of the size AA or larger. The energy supply units 2 can also have any other alternative energy storage technology which is suitable for supplying the actuation module 10 with energy. The power supply units 2 can be protected against splashing water by the housing 7 and are thermally insulated in the housing 7. The housing 7 can be a continuous housing. However, it is also possible for the power supply units 2 to have separate housings or chambers which do not allow direct open access to the rest of the housing 7. For example, the energy supply units 2 can be separated from the rest of the mechanics and electronics by means of chambers. As a result, the energy supply units 2 represent a separate, water-respectively vapor-sealed component of the actuation module, which can be charged for example by induction charging or any other charging technology. Despite the sealing, the power supply units 2 can be easily replaced as soon as they are no longer hard-wearing. The charging of the energy supply units 2 by means of induction (or any other charging technology which allows charging in a wet, humid environment) allows charging in a moist environment such as that of a kitchen without any danger. Consequently, the power supply units 2 of the illustrated actuation module 10, in contrast to the energy supply units of other applications of this type, are better protected with respect to moisture and cannot be damaged by moisture respectively can be damaged only with difficulty. The provision of two power supply units 2 is merely an example. The actuation module 10 can basically also be operated with only one of the two power supply units 2. More than two power supply units 2 are also possible.

The mechanical control elements of some stoves are not placed in the center of the front panel of a cooking apparatus. For instance, in case of electric stoves, the heating elements of the cooker often require that the mechanical control elements to be installed very deeply or close to the oven arranged below. In the event that the actuation module 10 has to be longer than the normal actuation module 10 because of an individual sensor configuration of a user, the actuation module 10 has position adjustment elements 11 which enable the actuation module 10 to be also mounted on stoves which do not feature mechanical control elements that are placed in the center of the front panel of the stove. Without the provision of position adjustment elements 11, the actuation module 10 cannot be attached or not ideally attached to some cookers. This is for example the case if the actuation module 10 has an extensive sensor configuration.

The position-adjusting elements 11 can for example have holes in different positions, for example adjacent to a standard insert in the center, and can be fastened to the front cover 8 and the rear cover 13 in order to adjust the position of the actuation module 10. Before the individual position adjusting elements 11 can be attached to the front cover 8 and the rear cover 13, the positions of the electric motor 3 and the manual control unit 1, which are arranged inside the housing 7, can be adjusted manually via the adjustment rail 12 in order to allow the actuation module 10 to be configured to the height that is required for an individual stove. Thus, the position of the actuation module can be adjusted quickly and comfortably. However, the height adjustment functionality by means of position adjusting elements 11 is optional. When the height adjustment functionality is omitted, elements such as for example the position adjusting elements 11 or the adjusting rail 12 can be omitted, whereby the width of the actuation module 10 and thus the space consumption can be substantially reduced.

The actuation module 10 can also have an induction charging cable. The induction charging cable (not shown) can be arranged on a tensioning pulley and utilized to charge the power supply units 2 of the actuation module 10 quickly for example even while the actuation module 10 is being used. In this case, the actuation module 10 does not need to be removed from the stove in order to charge it. However, for ordinary charging, the actuation module 10 can for example also be removed from the cooking apparatus and inserted into a charging station.

An actuation module 10 can also be integrated into new stoves. Some stoves, such as (cheap) gas stoves, are not constructed to be used in electrified environments. For instance, in many households there is no power supply provided in the vicinity of the cooker. Nevertheless, the separate power supply units 2 in the edge regions of the actuation module 10 enable such stoves to be used with precise temperatures. For instance, in some cases the energy supply units 2 can also be used as emergency power supply in the event that the actuation module 10 is supplied with energy via the individual energy supply of a new stove. In the event that the actuation module 10 is implemented in a new stove, for example magnetic fixation elements which are mounted within a small indentation on the front panel of a new cooker (the indentation can exactly correspond to the shape of the actuation module 10) may replace the fixation elements 9 which are mounted on adhesive elements. Furthermore, in case the actuation module 10 is implemented in a new hearth, the actuation module 10 may be mounted outside the hearth instead of being installed within the hearth. This allows easy maintenance of the actuation module 10 if a part of the actuation module 10 (electric motor 3, microprocessor unit 6, etc.) has to be repaired or replaced.

Since the actuation module 10 is a structural part of the stove which is attached externally to the cooker, it can be easily removed and returned to maintenance. During maintenance, for example fault diagnosis and repairs can be carried out. In case for example only the manual control unit 1, for example in the form of a circular touchpad or circular touch screen 14 (see figures. 4 and 5) is defect and has to be returned for maintenance, it is possible that for example a replacement control unit 1 (for example a spare display or a display of a further actuation module 10 that is possibly present in the user's home) can be attached to the respective actuation module 10 during the time required for the repairs. As a result, a complete functionality and interoperability of the actuation module 10 can be ensured. Furthermore, a mechanical control channel has a lower error risk and thus ensures operability even in case an electrical component is defect. Even though the actuation module 10 is not mounted on the cooker, since it is for example currently undergoing maintenance, the stove can still be used by means of mechanical regulation.

When the actuation module 10 is for example integrated into a new stove, the actuation module 10 can for example also be supplied by the power supply of the stove. The stove may be appropriately trained to be operated in an electrified environment. In this case, the power supply of the actuation module 10 can for example be established via an induction charging interface between the front panel of the cooker and the rear cover 13 of the actuation module 10. The power supply units 2 of the actuation module 10 in this case for example have the function of an emergency power supply for the actuation module 10.

Figure 4:
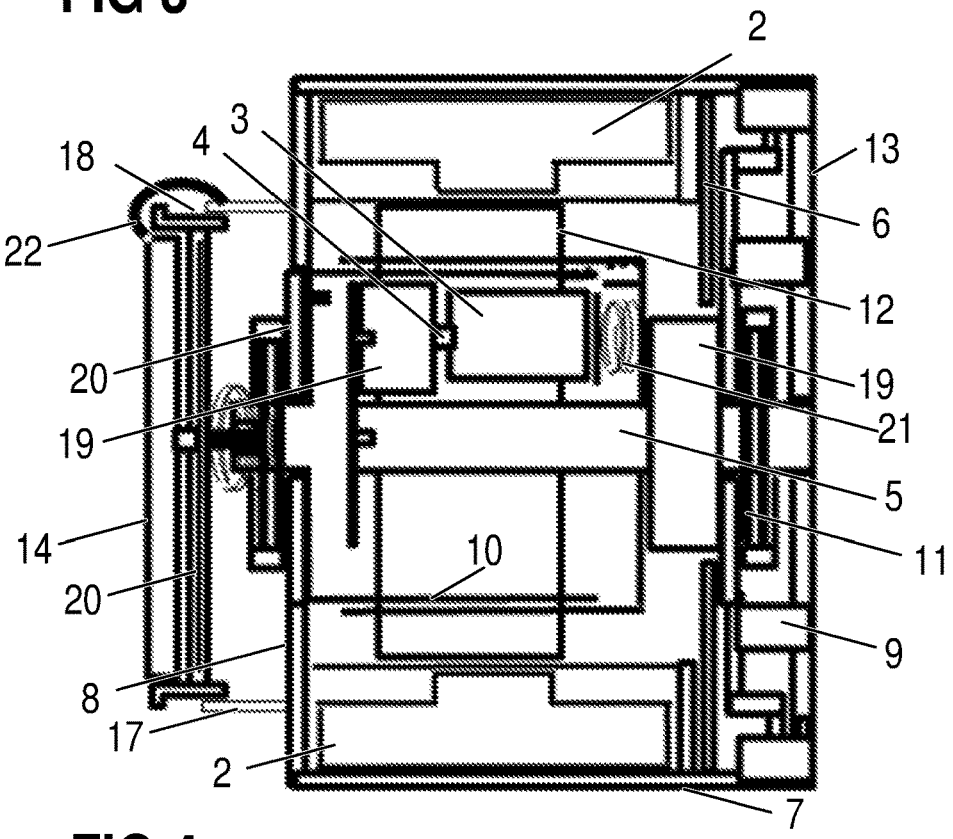
FIG. 4 shows a cross section of a further example of an arrangement for controlling a cooking process.

As illustrated by way of example in FIG. 4, the manual control unit 1 can also feature a display 14, for example a touchpad or touchscreen. The display 14 can, for example, be circular in shape in order to relate to the shape of an operating element of a stove. However, any other form of the display 14 is also possible. A display 14 can for example be provided when the actuation module 10 is integrated into a new range and is thereby supplied with energy by the energy supply of the new stove. Yet also in other cases a display 14 can be provided. The functionalities of such a display 14 can be the same as the functionalities or characteristics of the manual control unit 1 illustrated in FIGS. 1 to 3, but a display 14 may, for example have additional features and functions which are not possible with a conventional control unit 1. The construction of the actuation module 10 in FIG. 4 is fundamentally the same as the construction of the actuation module 10 shown in figures. 1, 2 and 3. However at the actuation module 10 shown in FIG. 4 the manual control unit 1 is formed as a (circular) touch pad 14 or as a (circular) touch screen, which is fastened to the housing 7 of the actuation module 10 by means of a mount 17. The display 14 shown in FIG. 4 does not have a pivoting function, but optionally offers additional useful functions in comparison to the manual control unit 1 shown in FIGS. 1-3.

The display 14 can have an elevation 18 on its outer side. The elevation 18 may allow for manual intervention by a user or the initiation of a cooking process by the use of the manual actuation module 1. A cooking process or the hearth power can for example be initiated only by pressing the display 14 without pressing the elevation 18 on the outside of the display 14 and rotating the elevation 18 on the outside of the display 14. In this case, for example the elevation 18 on the outer side of the display 14 cannot be pressed. An additional possibility for initiating a cooking process or for activating the stove power is for example to press and rotate the elevation 18 autonomously without having to press the manual control unit 1 (touchpad 14) separately. In this case for example one or more coils 20 can also be mounted in or on the manual control unit 1 in order to enable a cordless charging. The one or more coils 20 can, for example, be arranged in the part of the elevation 18 on the outside of the display 14, which is covered by the display 14. By means of the one or more coils 20 for example a power supply of the display 14 can be charged as soon as the display 14 is connected to the actuation module 10 by the user, for instance by inserting the display 14 into the elevation 18 on the outside of the display 14.

Depending on how the cooking process or the initiation of the cooking process is implemented, the display 14 can rotate or not. For instance, the display 14 can rotate when the user makes a manual adjustment of the hearth output or in case the electric motor 3 performs an adjustment of the hearth output. However, it is also possible that the display 14 does not rotate in case a manual intervention is performed by a user or by the electric motor 3. Consequently, the display 14 can be completely separated from the elevation 18 on the outside of the display 14. As a result, only the elevation 18 on the outside of the display 14 is connected to the manual actuation module 1. In order to prevent the rotation of the display 14 in this case, for example a curved display fixing element 22 can be mounted on the upper edge of the display 14 in a vertically movable manner, which connects the display 14 either to the front cover 8 or with the mount 17 when the display 14 is located in the elevation 18 on the outside of the display 14 and thus prevents a rotation in the event of a manual adjustment of the hearth output by the user or the electric motor 3.

In addition, for example, the display 14 can also be partially connected to the elevation 18 on the outside of the display 14, so that the display 14 for example can be connected by the application of guide rails, which can be implemented on the inside in the elevation 18, and thus it is possible for the display 14 to be moved or pressed along the guide rails. In this case, the elevation 18 on the outside of the display 14 is the only element which is directly connected to the manual control unit 1 (not shown).

Furthermore, the elevation 18 can also be completely connected to the display 14. The display 14 can for example be programmed by the user with different gesture controls to execute commands. Possible commands are for example "perform the first cooking process of a recipe", "turn off the cooker", "change the cooker output to the slow cook mode", "change to the nutrient maintenance mode","change to the warm holding mode", "switch to hot-fry mode". Any other type of command which might be helpful before, during, or after a cooking process is also possible. Gesture controls with which the display 14 can be programmed could for example consist of the wiping of letters, numbers, figures, or certain pushing sequences, for example a short push followed by a long push etc. on the display 14. Moreover, the actuation module 10 could be intelligent and therefore be able to talk with the user or answer questions of the user regarding for example of a particular recipe, or for example suggest recipes which can be prepared with the ingredients which are for example in an intelligent refrigerator or similar intelligent kitchen-related applications, for example an intelligent spice drawer or any other device of whose existence in an individual household the actuation module 10 could have knowledge of due to corresponding data received for example from a smartphone app which is concerned with the subject matter of shopping lists organization or the organization of the online (food related) purchases. Such an app can, for example, also be integrated simultaneously into the display 14 so that a user can take along the display 14 or an external device, for example a smartphone with an app installed on it when going shopping or for example to so that the consumer obtains a corresponding overview on the display 14 or for example so that the user can make online purchases in this manner.

In the event that the elevation 18 is used to ensure a push functionality that for example can be implemented with the manual control unit 1 into the actuation module 10, an indentation on the outside of the elevation 18 which is mounted on the mount 17 for the display 14, can provide additional distance respectively provide an extended action radius for the execution of the push functionality. Regardless of whether the display 14 can rotate (depending on how the implementation is carried out which is described elsewhere), the display can at any time recognize gestures respectively the image which is displayed by the display 14 does not rotate in case a touch screen is used if the electric motor 3 or the user (via the manual intervention function) adjust the stove power, for example by means of the use of a position sensor which can be arranged in the display 14, therefore the display 14 can at any time illustrate a horizontal image, even if the display 14 rotates mechanically. For instance, in case the actuation module 10 is integrated into new stoves, the display 14 can be used to implement gestures which must be performed to unlock the stove or to unlock the functions of pushing and rotating to initiate a cooking process, for example in order to raise the level of child safety. In the event that the display 14 has a touchscreen instead of a touch pad, the touch screen can be programmed in the same manner individually with gesture controls by a user as the touchpad. However, the touchscreen also provides all the functions known from current smartphones or so-called smartwatches. These are for example access to (cooking) apps, videos, audio and video instructions regarding for example the execution of recipes or instructions on when which ingredient (if necessary, possibly also in what quantity) must be added during a cooking process, the connection with devices such as for example smartphones for the exchange of data packets such as for example recipes, message alerts or email alerts, remote access to (cooking) apps of a smartphone or any other function or instruction that could make the cooking process more comfortable and more rewarding for a user, but are not explicitly mentioned here.

In order to be able to carry out instructions. regarding the quantity in which certain items have to be added, it is for example also possible to use an intelligent scale which is connected to the actuation module or which, for example, can also be integrated in an intelligent spice drawer. If the actuation module 10 or the display 14 is connected to an intelligent scale, for example the corresponding data stream can be timed in a way that ensures that the respective spices or other ingredients whose exact weight is of particular relevance for an optimal cooking process, can be weighed in time respectively in advance, so that they can be actually added in the required quantity, at the optimum point of time respectively at the adequate heat output.

The functions with regard to the described gesture control can also be implemented in the actuation module 10 by means of an image sensor, which is arranged in the front cover 8. The image sensor can for example detect gestures such as for example letters, geometric forms, or any other gestures that the user could perform in the air when he is standing in front of the hearth. The gestures need not be predetermined but can for example also be completely individually programmed by the user and for example have the same functions that have already been described above. In addition, the image sensor arranged in the front cover 8 and/or the display 14 can also be used to scan for example barcodes which contain information relating to an individual cooking process, for example times and temperatures or other relevant data. In addition, the gesture control of the actuation module 10 for example can also be compatible with intelligent image sensors which could be distributed everywhere in a smart home, consequently it is possible to access the actuation module 10 or to actuate the actuation module 10 (to a certain degree or to a certain, exactly defined extent) for example by third parties by means of the image sensors in the smart home. Furthermore, the actuation module 10 can for example also be controlled from similar objects which can be implemented in a fully connected smart home to a certain precisely defined extent. Such objects can for example be intelligent loudspeakers (control of the actuation module 10, for example by means of voice control), applications which combine the functions of intelligent image sensors and intelligent loudspeakers, intelligent ear plugs which can transmit audio input data to a smartphone or directly for example to the manual control unit 1 or to the display 14. In addition, the actuation module 10 can for example be trained to synchronize a cooking process in conjunction with an intelligent oven or other intelligent cooking utensils which are used for an individual cooking process so that all steps and elements of a cooking process are finished at the desired respectively correct time. The mounting of the display 14 on the actuation module 10 can be necessary for example if a push and turn mechanism, which is necessary for the initiation of the heat output, is to be activated. When this activation process has been carried out, the display 14 can then for example be removed again from the actuation module 10.

Figure 5:
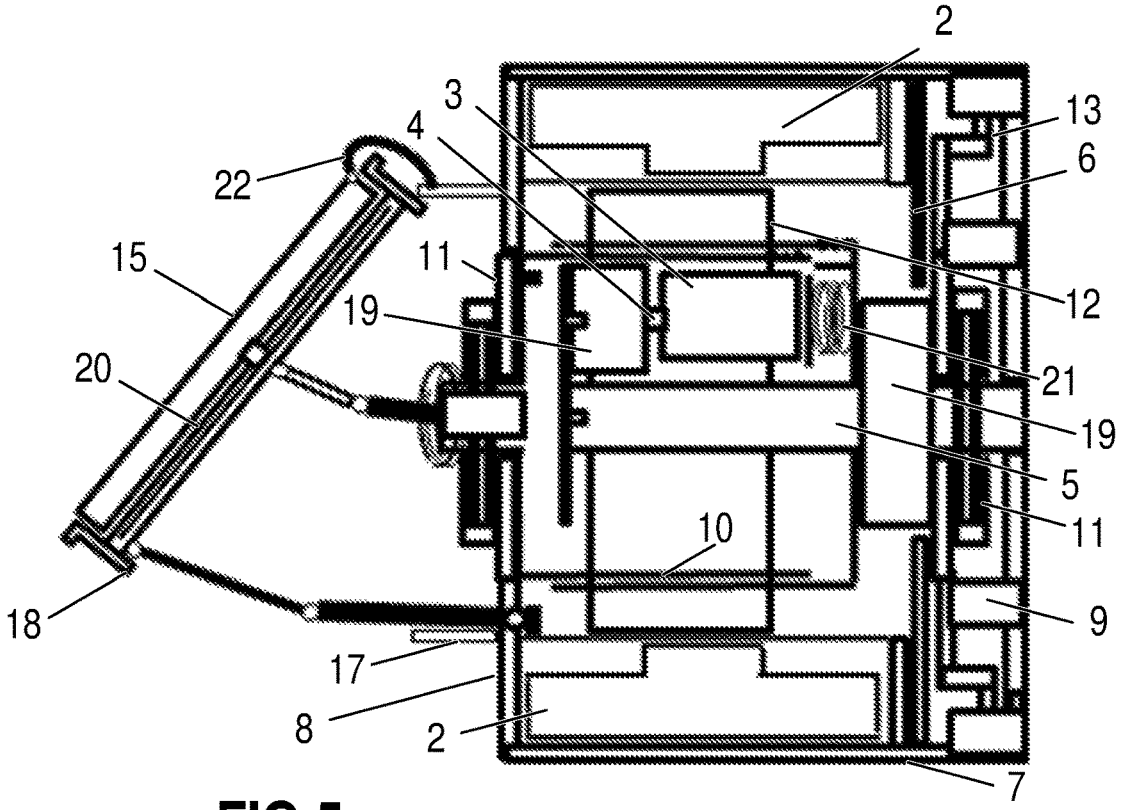
FIG. 5 shows a cross section of a further example of an arrangement for controlling a cooking process.
Figure 6:
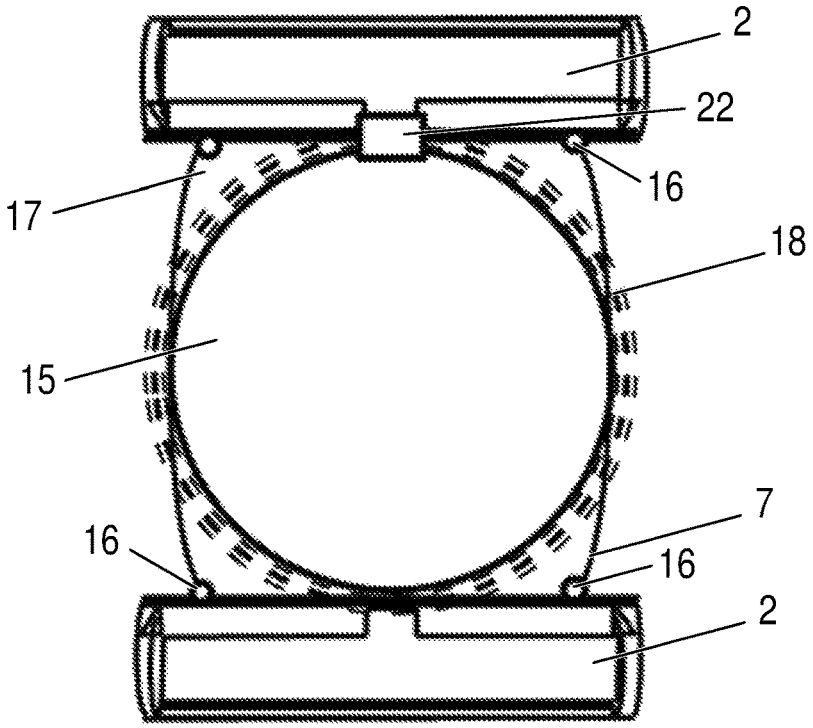
FIG. 6 shows a front view of a further example of an arrangement for controlling a cooking process.

As illustrated for example in FIGS. 5 and 6, the manual control unit 1 can also be replaced by a pivotable manual control unit 15 in the form of a circular touchpad or circular touchscreen (hereinafter referred to as a pivotable display 15). If, for example, the actuation module 10 is implemented in new stoves and can therefore be supplied with energy by the energy supply of the new stove instead of by the power supply units 2 of the actuation module 1, the power supply units 2 may be trained to perform the function of an emergency power unit. The pivotable display 15 basically has the same functions as the display 14 described with reference to FIGS. 3 and 4, but additionally has a pivoting function respectively the hearth power can also be regulated when the pivotable display 15 is pivoted outwards. In order to maintain the manual engagement function also when the pivotable display 15 is pivoted outwards, for example a ball joint can be arranged precisely in the center of the rear side of the pivotable display 15, which is for example is connected to a telescopic rod, which in turn is connected to the manual actuation module 1. This is illustrated by way of example in FIG. 5. Moreover, ball joints 16 may be mounted on the upper end of the mount 17 for the pivotable display 15 to ensure the pivoting function of the pivotable display 15. In addition, for example a bent telescopic rod (not shown) or a rod which consists of two telescopic rods which are connected to each other by means of ball joints in the center (not shown) or a telescopic rod which is divided by ball joints (cf. FIG. 5) at the lower end of the mount 17 can make it possible for the pivotable display 15 to be pivoted outwards.

The lower telescoping elements could also consist of individual thin, slightly curved, overlapping elements or elements connected by means of guide rails (the width of an element may each be, for example, 0.5 cm each), which can be fastened to the mount 17 by means of the use of ball joints. As soon as the maximum angle of the pivoting function is reached, the mount 17 is for example automatically locked, for example by using a click mechanism (not shown). In order for the pivotable display 15 to be pivoted back into the starting position, for example a button must be pressed. After the button has been pressed, the pivotable display 15 can be pivoted back into the starting position by the user. When the pivotable display 15 is pivoted outwards, the push mechanism, which is necessary to actuate the stove, is deactivated respectively the use of the push mechanism is not possible. The pivotable display 15 then has to be pivoted back again in order to be able to execute the push and turn mechanism procedure, which is necessary for the commissioning of the stove. The pivoting mechanism can for example also be implemented in a way that the elevation 18 on the outer side of the display 15 is mounted on a correspondingly dimensioned ball joint which can be moved vertically but not horizontally. The ball joint can, in turn, be mounted on a telescopic rod accordingly dimensioned for the purpose, which in turn is connected to the manual actuation module 1. As a result, the elevation 18 on the outside of the display 15 can for example be pulled outwards (exactly as is necessary for the pivoting mechanism) and pivoted in a subsequent process step by means of the ball joint. In this case, a mount 17 for the pivotable display 15 is not necessarily required for the implementation of the pivoting mechanism.

The actuation module 10 can for example also be designed in such a way that the display 14 is generally implemented obliquely in the actuation module 10 (not shown). In this case, the pushing mechanism required to operate the hearth is available at all times, since in this case there is no pivoting function. In this case, more space is also present in the interior of the actuation module 10, which, for example can be used for the implementation of components such as for example sensors etc. The pivotable display 15 or the elevation 18 on the outside of the display 15 can for example have a diameter which substantially corresponds to the height of the actuation module 10. In this case, the ball joints 16 can for example be arranged on the right and left upper edge of the front cover 8. In this case, the display fixing element 22 can for example engage on the upper side in order to fix for example the display 14 or the pivotable display 15 horizontally.

The front cover 8 has for example seals inside, which protect against water or moisture. Additionally, for example the front cover 8 is thermally insulated internally in order to protect the electronic elements from heat. The seals in the interior of the front cover 8 can for example be designed in such a way that they form a sealing unit with the seals which are mounted inside the housing 7 of the actuation module 10. A photovoltaic element (not shown) for example can be mounted on the front cover 7 in order to ensure a constant voltage supply for the actuation module 10. In addition, for example an image sensor can be arranged in the front cover 8 which can perform various functions as described above with respect to the image sensor.

The position adjustment functionality described merely provides a possibility of how such a functionality of this type can be implemented in an actuation module 10 for the automatic regulation of the stove power. The position of the actuation module 10 and/or the (pivotable) display 14, 15 can be implemented in any other suitable manner. The detachable position adjusting elements 11 in the center of the front cover 8 and the rear cover 13 can be used for example to ensure the possibility of the position adjustment of the actuation module 10. In order to adjust the position, the manual control unit 1 can for example be moved along an adjusting rail 12. In order to change the position of the actuation module 10, the same positional adjustment elements 11 can be used on the front cover 8 and the rear cover 13 and can also be mounted in the same manner in order to attach the actuation module 10 correctly to a stove. The position adjusting elements 11 of the front cover 8 can be the same as those on the rear cover 13. Accordingly, the position adjusting elements 11 of the front cover 8 can also be used on the rear cover 13 and vice versa to ensure comfortable position adjustment of the actuation module 10. The position adjusting elements 11 for the front cover 8 or also the entire front cover 8 can provide for example an increment in the form of a plateau (not shown) or might be arched outwards in any other way. In this case, there is partly more space inside the actuation module 10, which can be used for example to implement a (possibly electromagnetic) micro (slip) clutch 19 to the engine drive shaft 4. In this case, the actuation module 10 can be thicker at the thickest location than for example in the case flat position adjusting elements 11 are utilized and the position adjusting elements 11 of the front cover 8 cannot be used on the rear cover 13. Each position adjusting element 11 can for example also have O-rings which protect the interior of the actuation module from water and moisture. By connecting the O-rings to the position adjusting elements 11, they are easy to exchange since the position adjusting elements 11 are detachable. The use of different position adjustment elements 11 allows the end of the adapter piece 5 to be sealed or protected from water and moisture, while the position of the actuation module 10 can be individually altered.

The manual control unit 1 of the actuation module 10 is only an example of how a function of this type can be implemented in an actuation module 10 for automatic control of a cooker or in a similar appliance. The manual control unit 1 ensures that the actuation module 10 can be operated manually and that the actuation module can only be used if the user has initially activated it manually by pressing and/or turning the manual control unit 1 into the starting or operating position. The actuation module 10 may comprise an operating system. After activation, the operating system of the actuation module 10 can take over the cooking process. Nevertheless, the automatic power control can be switched off and put back into operation at any time by a user, for example via the actuation of a button or a key button on the actuation module 10. More specifically, the manual control unit 1 may have two parts, namely, an inner part and an outer part. For example, several layers or dimensions of the manual control unit 1 may also be provided in order to implement pushing mechanisms with two or more stages (not shown). Only the outer part of the manual control unit 1 can for example be connected to the drive shaft 4 which is operated by the electric motor 3. In a zero position, the inner part of the manual control unit 1 can be fixed by a wedge which is for example placed on the front position adjusting element 11 and by means of for example a counter-pressure spring 21 for example in the form of a plate spring (not shown) attached to the inner end of the outer part of the manual control unit 1. In case the manual control unit 1 is pressed and/or rotated, the inner part of the manual control unit 1 is disengaged from the wedge and placed on wedges which are for example are mounted on the inner part of the outer part of the manual control unit 1. The outer and inner parts of the manual control unit 1 can for example be connected to one another in this manner. A circuit of the electric motor 3 or the entire actuation module 10 (in this case, the pushing mechanism could also be used as a main switch for the entire actuation module 10) is thereby closed and the power can be regulated both by the manual intervention function provided by the manual control unit 1, as well as with the electric motor 3. As soon as the zero position is reached again, the inner part of the manual control unit 1 is re-coupled to the wedge which is for example arranged on the front position adjusting element 11 and can therefore not be moved again. Accordingly, the actuation module 10 has an operating range which for example can reach from five per cent to 100 per cent of the hearth power of a specific hearth since the actuation module 10 returns to the neutral position at a specific point when the hearth power is reduced to zero percent or the zero position. Some stoves also have an inverted power scale that starts at maximum power. At such stoves for example the actuation module 10 can spring back into the neutral position at a specific point when the hearth power is raised in the direction of one hundred percent respectively the zero position.

Consequently, the stove power generally cannot be reduced or increased arbitrarily by the power regulation system of the actuation module 10. A (possibly electromagnetic) micro-slip clutch 19 can be arranged for example at the distal or outer end of the outer part of the manual control unit 1 in order to limit the torque which can be generated by a manual intervention by the user. The (possibly electromagnetic) micro-slip clutch 19 can for example also be mounted at the connection to the motor drive shaft 4 in order to protect the transmission of the electric motor 3, which is necessary for an application of this kind, from the torque created by a manual intervention of a user with the manual control unit 1 or to limit the torque executable to the transmission of the electric motor 3. More specifically, for example a proximity sensor respectively image sensor which may be implemented in the front cover 8 and/or in the display 14 (not shown), or a touch sensor which can be implemented in manual control unit 1 or in the elevation 18 on the outside of the (pivotable) display 14, 15 can ensure that a (possibly electromagnetic) micro-slip clutch 19 separates the connection of the drive system from the electric motor 3 , so that the motor drive shaft 4 is not involved in the rotation which is initiated by the manual intervention of a user.

There are many other alternative possibilities for implementing an (possibly electro-magnetic) micro-slip clutch 19 or other torque-limiting or regulating elements in an actuation module 10 for automatic power control of a cooker in order to protect the transmission of the electric motor 3 during manual intervention. The manual control unit 1 can for example be adjusted along an adjusting rail 12, in the event that the position of the actuation module 10 has to be changed. The manual control unit 1 can be fixed on the adjusting rail 12 with the position adjustment elements 11. In the event that the actuation module 10 as a whole is torn out of its anchoring intentionally respectively with force, or stands shortly before of being torn out of its anchoring intentionally by a user during a cooking process (for example by a child), the electric motor 3 is trained to move to the zero position as quickly as possible. The electric motor 3 can determine the zero position for example by means of a position sensor. More specifically, for example on the right, left, lower and upper side of the housing 7 of the actuation module, for example capacitive tactile pressure measuring sensors (not shown) can be arranged, which for example can detect pressure. If for example the detected pressure exerted on the actuation module 10 exceeds a certain threshold value, it can for example be concluded that the actuation module 10 could either be removed during a cooking process or torn from its anchoring by force respectively intentionally. The anchoring can for example be ensured with the detachable fixation elements 9 which are mounted on adhesive elements or non-detachable magnets. Principally a certain pressure is required to remove the actuation module 10 from the detachable fixation elements 9 and the non-removable magnets, unless the (click) mechanism provided for this purpose is used. Even if for example the button is pushed in order to trigger the click mechanism for the removal of the application, the actuation module 10 can automatically return to zero position immediately.

Accordingly, in the case a situation of this kind is recognized, the cooker power is controlled to the zero position as quickly as possible to prevent the cooker output from being activated while no control unit regulates the cooker output accordingly. Additionally, for example a warning can be performed by the actuation module 10 in a situation of this kind, for example a signal for example in the form of one or more sharp or loud whistle sounds. In addition, the actuation module 10 can for example regulate into the neutral position when the proximity sensor or the image sensor detects that no person has stood in front of the hearth for a certain period of time and/or in case the actuation module 10 (which is for example fully connected in the Internet of Things of a smart home) is notified by other smart gadgets such as by an intelligent alarm system that no one is left in the house even though the presence of a user for the recipe or cooking operation that is currently being executed by the actuation module 10 is necessary. In this case for example a (for example red) flashing indication can occur on the (pivotable) display 14, 15 or for example the zero position can be activated. Such a (for example red) flashing can also occur for example if the actuation module 10 threatens to overheat because for example the oven arranged below the hearth is opened too long. Moreover, in case the actuation module 10 detects that it is for example no longer connected to a smartphone, for example it could be controlled to the zero position during the execution of a cooking process. The fact that no smartphone is located in the vicinity of the actuation module 10 can be interpreted as an indication that there is no user in the vicinity of the cooker.

Specifically in the case of electrical stoves, the manual control unit 1 can be of significant significance for the actuation module 10, since this type of stove typically does not have any pushing mechanisms installed in order to initiate the stove power or a cooking episode. Furthermore, for example temperature sensors (not shown) can be installed at neuralgic points of the actuation module 10. If these sensors measure temperatures above a certain temperature threshold, for example because the oven which is currently in operation is opened for too long, it is possible for example to indicate the user in various ways. For example, the (pivotable) display 14, 15 can flash red or a sound can be emitted. The oven (baking pipe) can, for example, also be controlled by an intelligent technology corresponding to the actuation module. If this is the case for example this control system can for example also regulate the oven into the zero position or temporarily reduce the power until the oven is closed again.

The power supply units 2 can be arranged in a decentralized manner in the interior of the actuation module 10. In this way, space is provided inside the actuation module 10, which for example can be used for the implementation of slide clutches or for the implementation of additional sensors. The power supply units 2 can be removable (for example, by using a click mechanism or a sliding mechanism) and can have special seals which protect them from moisture and heat. The energy supply units 2 can be charged for example by plugging the entire actuation module 10 into a charging station, or by connecting an induction charging cable, which is for example mounted on a small tensioning roller, to the actuation module 10 while the latter is mounted on the hearth respectively is it possible to charge the actuation module 10 with any other charging technology which is suitable for this purpose. If the power supply units 2 need to be replaced, they can simply be replaced. The actuation module 10 can also be used if only one of the two power supply units 2 is available or if the actuation module 10 has only one power supply unit 2.

The electric motor 3 or a similar suitable drive system can be used to control the cooker power under the use of a ratio determined by the slot in which the adapter piece 5 is mounted. As already mentioned above, the adapter piece 5 can be changed in its position in order to adapt the actuation module 10 to different hearth geometries. Various slots can therefore be arranged on the rear side of the actuation module 10. These can for example be arranged at different heights. Moreover, the different slots can also be arranged offset to one another, for example in the horizontal direction (right/left). Depending on the height at which the control elements are arranged on the hearth or how closely the control elements are arranged next to one another, the adapter piece can be inserted into a corresponding slot before the actuation module 10 is mounted on the hearth. In principle, however, it is also possible first to provide the adapter piece 5 on the hearth and then to apply the actuation module 10 by inserting the adapter piece 5 into the corresponding slot.

The slot can be rotatable so that a rotation of the slot causes a rotation of the operating element connected to the slot. A first gearwheel, can for example drive the slot in which the adapter piece 5 is mounted. A second gearwheel can be connected to the (possibly electromagnetic) microslip clutch 19 or the motor drive shaft 4. The first gear wheel can for example be connected directly to the second gear wheel, by means of an additional gearwheel (not shown), a worm gear (shown), bevel gear (not shown), hypoid bevel gear (not shown), a spiral bevel gearwheel (not shown) or any other coupling technique which could fulfill the required purpose. In the case a bevel gear (not shown), a hypoid bevel gear (not shown) or a spiral bevel gear (not shown) is used, one end of the bevel gear may be for example propelled by the motor drive shaft 4. The other end is for example connected to the first bevel gear. Moreover, in case an electric motor 3 is used as a driving unit, this motor 3 may for example have a high rotational speed and for example a planetary gear to save energy during operation.

The adapter piece 5 for the actuation module 10 can have any desired shape. Often the control elements of different gas ranges and electric ranges also have different shapes and sizes. For example, different adapter pieces 5 with different shapes and sizes can be provided for an actuation module 10. Thus, the user can use the adapter piece 5 that optimally suits his cooker. In principle, however, there is also the possibility that an adapter piece can be changed in its shape and/or size in order to be able to adapt the adapter piece to different shapes and sizes of operating elements.

The microprocessor unit 6 can for example be trained to process information about cooking temperatures or to process information relevant to the cooking process from various sensors (for example temperature sensor or image sensor). The microprocessor unit 6 may alternatively or additionally be configured to execute the decoupling during a manual intervention and/or to control all functions of the actuation module 10. Furthermore, the microprocessor unit 6 can for example be trained to receive and process recipe information which for example contains the instant of time and the quantity of an individual ingredient which is necessary during a cooking process of an individual recipe and correspondingly illustrate information for example via the (pivotable) display 14, 15. Simultaneously, the microprocessor unit 6 can optimally control the cooker power. For example, data on one or more patterns or optimum processes of an individual cooking process can be known to the microprocessor unit 6. A sample process can be for example carried out beforehand by a professional cook and the data of this cooking process can be correspondingly documented or programmed. Such data, in addition or alternatively to other information about a cooking process, can serve as information input for a respective cooking process. If the number of people in a cooking process varies (for example a recipe is cooked for 2 persons or for 4 persons), the input data sets can be correspondingly scaled up or down to provide the correct amount of ingredients respectively in order to correctly control the corresponding stove power. The input with regard to this information can be provided to the actuation module 10 for example by data provided by the actuation module 10 itself or by a third-party device connected to the actuation module 10 (for example cooking apps of a smartphone), via the internet or via data from barcode information. This data can additionally be used to ensure that an individual recipe can be reproduced to one hundred percent by a user without any specific knowledge which basically would be necessary for perfect outcomes. Owing to its energy-efficient architecture, which automatically prevents peak temperatures in case for example food is cooked in a pot, an effective instrument is created in order to prevent overcooking or burning on the bottom of cooking pots or cooking pans. Furthermore, the actuation module 10 for example normalizes the stove power for example for various types of frying (for example sharp frying, frying, gently roasting, keeping warm etc.). Sharp frying for example is carried out only very rarely by the actuation module 10, so that the food which is in a pan is not burnt. Alternatively, the actuation module 10 can alert the user when the desired temperature required for an individual cooking process has been reached.

A longer episode of the sharp frying by the user is therefore performed regularly for example by means of the manual intervention function of the actuation module 10 respectively the power regulation system can be switched off and on by the user at any time by means of the use of a button (not shown) mounted on the actuation module 10. Moreover, the actuation module 10 can for example have a voltage monitoring element (not shown) which can be arranged directly on the microprocessor unit 6 or at another location within the housing 7. More specifically, the voltage monitoring element can be trained to detect a reduction in the voltage or to serve as a detector for under-voltages when the power supply 2 of the actuation module 10 decreases gracefully (significantly, substantially). This is generally of great importance because the voltage of the power supply 2 could reach a critical level which could possibly lead to the microprocessor unit 6 not being able to operate correctly.

The voltage monitoring element (not shown) can thus ensure that the actuation module 10 is regulated to the zero position before such malfunctions could occur in case the voltage level of the power supply 2 is too low. In addition, a small emergency power supply (not shown), for example in the form of a (mini) accumulator, can be implemented in the actuation module 10, which has a separate voltage circuit within the actuation module 10. This separate voltage circuit can for example feature the electric motor 3 as well as the emergency voltage supply. In case the microprocessor unit 6, the power supply 2 or any other component is defective, it can be provided that the emergency power supply regulates the actuation module 10 to the zero position. To provide this functionality, the emergency power supply e.g. may be trained to rotate the motor drive shaft 4 until the inner part of the manual control unit 1 is fixed on the wedge which is located for example on the front position adjusting element 11. This function, which can be provided by an emergency power supply, can for example also be implemented mechanically for example by utilization of a preloaded spring (not shown) that can be installed inside the actuation module 10. The control of the electric motor 3 and/or the (possibly electromagnetic) micro-slip clutch 19 can for example also be provided wirelessly by the microprocessor unit 6 of the display 14 or also by the microprocessor unit of the pivotable display 15. The control of these two elements can in turn be performed by for example a smartphone.

Thus, the sensor data generated by a wide variety of sensors (e.g. temperature sensor or any further sensors) can basically be processed by both components, namely the microprocessor unit 6 and the microprocessor unit of the display 14 or the pivotable display 15, and thus produce two data streams which in turn can be additionally evaluated by the respective other component in order to eliminate possible disturbances and to identify malfunctions in time or at an early stage. In addition, by means of this systematics, the correct functionality of other components of the actuation module 10 can also be monitored in order to detect malfunctions of the temperature sensor or further sensors whose data is processed as input material for a cooking process, the electric motor 3 or the (possibly electromagnetic) micro-slip clutch 19 at an early stage.

The operational orientation of the microprocessor units described above can for example also be implemented in such a way that for example operating systems of the display 14 or of the pivotable display 15 are isolated respectively shielded by for example one or more firewalls or other protection applications from the operating system of the microprocessor unit 6. The operating system of the (pivotable) display 14, 15 can for example execute application programs or for example mirrored duplicates of application programs that are installed on a different operating system (for example the operating system of a smartphone), or are used as data inputs (for example operating system of a smartphone). By shielding the different operating systems, elements which can for example possibly damage the operating system of the display 14 or the pivotable display 15 or which could impair their correct functionality can be prevented from impairing the correct functionality of the microprocessor unit 6. Thus, even in the case of for example viral corruption of the processed data contents, interference-free operational functionality is ensured respectively its impairment is identified at an early stage, even if for example one of the two generated data packets contains disturbances which could potentially affect the correct sequence of a cooking process. Correspondingly, the (pivotable) display 14, 15 could be trained to interrogate historical protocols of possible disturbances (for example, a virus attack of a smartphone connected to the actuation module 10) from the operating system of the respective smartphone in order to assess possible risks. In addition, the operating layout of the actuation module 10 can be set up in such a way that the operator/manufacturer of the control device (of the actuation module 10, the application or the operating system) knows and audits the source data of a cooking process from the respective originator of the data. Hence the operator/manufacturer of the cooker control knows this data before it is possible for a user to apply it. In this manner, additional data reconciliation could be performed.

The housing 7 of the actuation module 10 may for example have seals on the inner sides and the corners in order to protect the electrical components inside the housing, for example the electric motor 3 and the microprocessor unit 6 for example from heat, water and moisture. In addition, the seals of the housing 7 can form a sealing unit with the seals which are attached to the inside respectively at the corners of the front cover 8 respectively the rear cover 13 in order to provide an optimized protection against water and moisture.

The rear cover 13 of the actuation module 10 can have the same seals as the front cover 8. The rear cover 13 of the actuation module 10 can for example have indentations on the upper end, on the lower end and on both sides, which can correspond precisely to the form of for example the four detachable fixation elements 9. The detachable fixation elements 9 can for example remain on the stove (are connected to the stove) as soon as the actuation module 10 has been mounted on the hearth for the first time. Consequently, the actuation module 10 can be removed from a cooking appliance while the removable fixation elements 9 remain on the cooker. The rear cover 13 can also have additional further indentations into which magnets can be fitted in order to provide additional stability to the actuation module 10, for example in the event that the actuation module 10 is operated on a magnetic stove surface.

The detachable fixation elements 9 can have holes at the locations at which magnets are mounted on the rear cover 13, so that it is ensured that the magnets can also directly contact a possibly magnetic front of a cooking appliance/cooker. The length of the magnets which is mounted outside the rear cover 13 can thus correspond exactly to the thickness of the removable adhesive elements which are mounted on the hearth. For example, the magnets cannot be removed from the rear cover 13. Furthermore, the magnets can sometimes ensure that a certain pressure must be exerted on the actuation module 10 in order to remove it from the hearth. The rear cover 13 may have an indentation which deflects exactly at the boundary of the fixation elements 9 and the magnets on the outer side of the rear cover 13. This indentation is trained to cover possibly existing elevations at the contact point between the actuation module and the mechanical adjustment of the cooking appliance. Moreover, this indentation can be trained to remove the adapter piece 5 from the actuation module 10 if it should be stuck when the actuation module 10 is removed from the hearth. In case no indentation is provided in the rear cover 13, it can basically be more difficult to remove an adapter piece from the application. Furthermore, each adapter piece 5 may have two small indentations at each end to facilitate removal of the adapter piece 5 from the application (for example by utilization of fingernails).

The detachable fixation elements 9 can form a structural removable part within the actuation module 10, which can be removed from the actuation module 10 when required, for example via the utilization of a click mechanism. Such a click mechanism can for example fix the detachable fixation elements 9 and the actuation module 10 together by means of a wedge or several wedges. For instance, the pressing of a button can enable this wedge or wedges to loosen again so that the actuation module 10 can again, by the release of this wedge or wedges, be separated from the detachable fixation elements 9. The actuation module 10 can, for example automatically adjust to the zero position if the button which releases the wedges is pressed and the hearth power is not at the zero position at this point of time. It can thus be ensured that the actuation module 10 cannot be removed until the zero position has been reached. It is likewise possible for example that the corresponding button can only be pressed when the actuation module 10 is in the zero position.

The detachable fixation elements 9 may e.g. comprise one or more non-detachable magnets that can be integrated into the rear cover 13, and detachable fixation elements 9 mounted on adhesive elements. The detachable fixation elements 9 can be mounted on the cooking appliance, for example by means of a heat-resistant silicone adhesive. In order to get as much adhesive as possible on the stove, for example four detachable adhesive elements can be utilized, which exactly fit into the corresponding recesses on the rear cover 13. Consequently, the detachable fixation elements 9 accurately fit into the rear cover 13 and can also be removed from the rear cover 13 at any time. For instance, the adhesive elements of both sides of the rear cover 13 each have two detachable fixation elements. The adhesive elements on the top and bottom of the rear cover 13 each have e.g. three detachable fixation elements. If, for whatever reason, the actuation module 10 cannot be mounted directly on a stove (for example, the adapter piece 5 could not have the correct length, or there may be a bump in the vicinity of the mechanical adjusting rod of the cooker 10 which prevents the actuation module 10 from being mounted directly on the stove), longer fixation elements 9 can be placed for example on the four adhesive elements in order to close the gap between the front panel of the cooking appliance and the actuation module 10. In such a case, a potential gap between the actuation module 10 and the stove can be covered with a cover which is attached to the gap (each fixation element 9 length has a corresponding cover).

In order to apply the actuation module 10 for the first time on a cooking appliance, a specific installation process can be carried out, an example of which is described below. For example, in case the actuation module 10 is for example implemented into new gas cookers, the installation process cannot be performed.

In a first step, for example the correct adapter piece 5 can be determined and the required length of the detachable fixation elements 9 can be determined. As a second step during the assembly of the actuation module 10, the position of the actuation module 10 (if this is necessary due to the extensive sensor configuration) can be adjusted and adapted for example by utilization of the position adjusting elements 11. As soon as the actuation module 10 has the correct position on the cooking appliance, the surface on which the actuation module 10 is about to be attached can be thoroughly cleaned. When the surface is clean or free of grease and dry, for example an interlayer can be removed from the rear cover 13 of the actuation module 10. For example, the adhesive of the adhesive elements (on which the fixation elements 9 are mounted) can be located underneath the interlayer. After the foil has been removed, the actuation module 10 can then be pressed (strongly) against the stove in order to adhere the adhesive of the adhesive elements to the stove. The adhesive can then be cured. The actuation module 10 can be attached to a hearth utilizing only one adhesive element instead of the four adhesive elements described above. Any other number of adhesive elements is possible.

When the adhesive is cured, the detachable fixation elements 9 are generally fixed to the hearth sufficiently. Thus, the actuation module 10 can now be fixed on the cooker. However, it can be removed at any time if this is necessary. The detachable fixation elements 9 can now no longer be removed from the hearth without the use of great force or sway. Should a fixation element 9 fall off the cooking appliance, it could easily be re-mounted on the cooking appliance, for example using heat-resistant silicone adhesive. Since the cooker, including the control elements, is usually soiled (e.g. grease and oil) during cooking, the surface on which the detachable fixation elements 9 are to be re-installed can be cleaned again profoundly. In case the actuation module 10 is integrated into new stoves, a cleaning step is generally not required.

An actuation module 10 for automatic power control of a cooker can for example be retrofitted to existing cookers with mechanical adjustment possibility or can be integrated in new appliances in a detachable manner. An actuation module 10 has for example a housing 7. Various components can be arranged in the housing. The actuation module 10 can also have a manual control unit 1, with which manual power control can be executed. The manual control unit 1 can have a push and rotate mechanism by means of which the cooker output can be initialized. This can be achieved for example via the manual control unit 1 and the utilization of a counter-pressure spring 21. The actuation module 10 can furthermore have power supply units 2 in order to provide a power supply for the actuation module 10 in the event that the actuation module 10 is retrofitted for example to an existing gas or electric cooking appliance. The actuation module 10 may further include a drive unit, for example in the form of an electric motor 3 with a (possibly electromagnetic) micro-slip clutch 19. The drive unit can for example drive a slot in which an adapter piece 5 is arranged by means of the motor drive shaft 4.

A microprocessor unit 6 can for example be used to process recipe information, information on cooking respectively frying temperatures, and/or information from one or more sensors (for example temperature sensors or image sensors). The actuation module 10 may include a front cover 8 (optionally with seals) and a rear cover 13 (optionally with seals), which may be used to mount various positional adjustment elements 11. In order to adjust the position of the actuation module 10 on the hearth, the actuation module 10 can also have an adjusting rail 12. The rear cover 13 for example has detachable fixation elements 9, which can be mounted on adhesive elements, and non-removable magnets. The manual control unit 1 can for example have a display 14 or a pivotable display 15, which can for example have an elevation on its outer side. The (pivotable) display 14, 15 can basically have the same characteristics and functions as a simple manual control unit 1 without a (pivotable) display 14, 15. However, a (pivotable) display can additionally have further functionalities such as for example coils for wireless charging 20. A pivotable display 15 can for example be pivoted outwards by means of ball joints 16, wherein the ball joints 16 can be arranged on the upper side of the mount 17 of the pivotable display 15. Likewise, for example on the upper side of the display 14, 15, for example a vertically movable display fixing element 22 can be arranged, which for example is connected with the front cover 8 or with the mount 17 of the pivotable display 15 in a detachable manner.

The invention claimed is:

1. An arrangement for controlling a cooking process, the arrangement comprising:

a removable housing with mechanical and electronic components of the arrangement, the housing being attached to a stove by the use of magnets;

an electric motor connected to an adapter piece that moves the adapter piece such that a push button of the stove is actuated by the movement of the adapter piece, and such that power of the stove is controlled by the actuation of the push button;

a microprocessor that can receive and process third party data relating to the cooking process and control the electric motor to move the adapter piece, wherein the microprocessor evaluates the third party data relating to the cooking process; and whereby the microprocessor can normalize the received third party data including times and temperatures energy efficient, if disturbances of the cooking process are detected;

a power supply to supply the arrangement with energy; and a removable display including a microprocessor, that can be removed from the arrangement;, and that is connected to the microprocessor of the arrangement via coils; whereby the mounting of the display on the arrangement is necessary if a push and turn procedure, which is necessary for the initiation of the heat output of the stove, is to be activated; whereby the operator/manufacturer of the arrangement knows and audits the source data of a cooking process from the respective originator of the data, to normalize the third party data energy efficient, as soon as the microprocessor of the arrangement detects disturbances of the third party data of the display connected to the microprocessor of the arrangement via the coils.

2. The arrangement of claim 1, wherein the removable display connected to the adapter piece in such a way that a movement of the removable display is transmitted to the adapter piece.

3. The arrangement of claim 2, wherein the microprocessor of the removable display is configured to display the third party data relating to the cooking process, and wherein the removable display is isolated or shielded by the coils from the microprocessor of the arrangement.

4. The arrangement of claim 2, further comprising a micro clutch that can transmit a movement of the removable display to the adapter piece.

5. The arrangement of claim 2, wherein the removable display can rotate when an adjustment of the stove power is carried out.

6. The arrangement of claim 2, wherein the removable display is a touch display, and wherein manual inputs can be performed by touching the touch display.

7. The arrangement of claim 6, wherein the touch display can detect swipe gestures.

8. The arrangement of claim 7, wherein the touch display is fixed to the housing via a fixation element.

9. The arrangement of claim 8, whereby the fixation element comprises at least one of:

a telescopic rod; and a ball joint.

10. The arrangement of claim 1, whereby the removable display comprises at least one of:

the display; and a pivotable display.

11. The arrangement of claim 1, wherein when the arrangement is mounted on the stove, the at least one power supply is arranged at a decentralized position of the housing.

12. The arrangement of claim 1, wherein the arrangement can receive the data relating to the cooking process to be carried out or to read out the data relating to the cooking process from a memory and to control the power of the stove as a function of the data relating to the cooking process.

13. The arrangement of claim 12, wherein the data relating to the cooking process comprises information concerning required temperatures and/or required cooking times.

14. The arrangement of claim 1, further comprising at least one sensor which can at least one of:

scan recipes or barcodes;

receive voice commands;

recognize user input in the form of gestures; and detect reducing gases.

15. The arrangement of claim 1, wherein the power supply comprises at least one battery or at least one accumulator.

16. The arrangement of claim 1, wherein the power supply can be charged inductively.

17. The arrangement of claim 1, wherein the stove power is controlled to zero, when the adapter piece is arranged in a zero position.

18. The arrangement of claim 17, wherein when the arrangement is mounted on the stove, the arrangement is removeable only from the stove if the adapter piece is arranged in the zero position.

19. The arrangement of claim 17, wherein the adapter piece is moved to the zero position upon detection that the arrangement is about to be removed from the stove.

20. The arrangement of claim 17, wherein the adapter piece can be moved to the zero position when no user is located near the stove.

21. The arrangement of claim 1, further comprising at least one temperature sensor that can detect a temperature of the arrangement.

22. The arrangement of claim 21, wherein the arrangement can control the stove power to zero, when the detected temperature exceeds a maximum value.

23. The arrangement of claim 21, wherein the arrangement can emit an acoustic or visual warning, when the detected temperature exceeds a maximum value.

24. The arrangement of claim 1, further comprising at least one slot that can receive the adapter piece, and wherein when the adapter piece is arranged in the at least one slot, a movement of the at least one slot results in a movement of the adapter piece.

25. The arrangement of claim 24, wherein the at least one slot is connected to the drive unit via at least one gearwheel.

26. The arrangement of claim 25, wherein:

the electric motor comprises a drive shaft;

the drive shaft is connected to a first gearwheel; and the at least one slot is connected to a second gearwheel.

27. The arrangement of claim 1, wherein the push and turn procedure can result in manual control of the stove.

* * * * *